United States Patent [19]

Ruenzi

[11] 4,346,879

[45] Aug. 31, 1982

[54] SHEET SEPARATING DEVICE FOR OFFICE MACHINES

[76] Inventor: Kurt Ruenzi, Kuesnachterstrasse 59, CH-8126 Zumikon, Switzerland

[21] Appl. No.: 181,676

[22] Filed: Aug. 27, 1980

[30] Foreign Application Priority Data

Sep. 7, 1979 [CH] Switzerland ..... 8076/79

[51] Int. Cl.[3] ..... B65H 3/52

[52] U.S. Cl. ..... 271/121; 271/167

[58] Field of Search ..... 271/121, 124, 104, 137, 271/167, 162, 127, 165

[56] References Cited

U.S. PATENT DOCUMENTS 650,410 5/1900 Morin ..... 271/121

FOREIGN PATENT DOCUMENTS 1966526 1/1973 Fed. Rep. of Germany ..... 271/162

2356602 6/1974 Fed. Rep. of Germany ..... 271/121

*Primary Examiner*—Richard A. Schacher

*Attorney, Agent, or Firm*—W. G. Fasse; D. H. Kane, Jr.

[57] ABSTRACT

The bottommost sheet of a stack is withdrawn for the feeding of original copy single sheets to a copying apparatus so that the stack lies in the same sequence after copying. Preliminary separating mechanisms (5, 12) and subsequent downstream separating mechanism (6, 22) are provided. These separating mechanisms each comprise a separating plate (12, 22) provided with a friction facing (20, 24) as well as a rotating separating roller (5, 6). The two rollers (5, 6) are driven by a motor (8) when a single sheet is to be transported.

2 Claims, 3 Drawing Figures

SHEET SEPARATING DEVICE FOR OFFICE MACHINES

CROSS-REFERENCE TO RELATED APPLICATION

The present application is based on Swiss Patent Application 8076/79-7; filed in Switzerland on Sept. 7, 1979. The priority of this Swiss filing date is claimed.

BACKGROUND OF THE INVENTION

The invention relates to a separating device for sheets of paper for feeding said paper sheets to an office machine, in particular to a copying apparatus, with transport means for pulling out one at a time, the respective bottommost sheet of a stack.

Swiss Pat. No. 483,976 discloses a device for separating single flat items, whereby each time the bottommost sheet is withdrawn from a stack. Such a device is well suited for relatively thick objects to be separated, such as newspapers or cardboard. Such a device is not constructed for thin sheets of paper.

OBJECTS OF THE INVENTION

It is an object of the invention to provide a sheet separating device which is also suited for the trouble-free separation of thin sheets of paper, whereby always the bottommost sheet is to be withdrawn from a stack.

It is another object to make sure that but one sheet leaves the device even though more than one sheet should have been drawn into the device.

SUMMARY OF THE INVENTION

According to the invention there is provided a device for separating sheets of paper from a stack and for feeding the sheets to an office machine, comprising bottom means (3) for supporting the sheet stack (4), at least a portion of said bottom means being inclined to the horizontal, first separating means (5, 12) operatively arranged for cooperation with said bottom means, and second separating means (6, 22) also operatively arranged for cooperation with said bottom means downstream of said first separating means (5, 12) as viewed in the direction of sheet advance.

Thus, the double transport of superposed sheets of paper is avoided. Also, papers of differing thicknesses may be separated without readjustments. Such a sheet separating device is especially advantageous for original copies that should be returned to the correct position and sequence or order after it has been copied.

BRIEF FIGURE DESCRIPTION

In order that the invention may be clearly understood, it will now be described, by way of example, with reference to the accompanying drawings, wherein.

Figure 1:
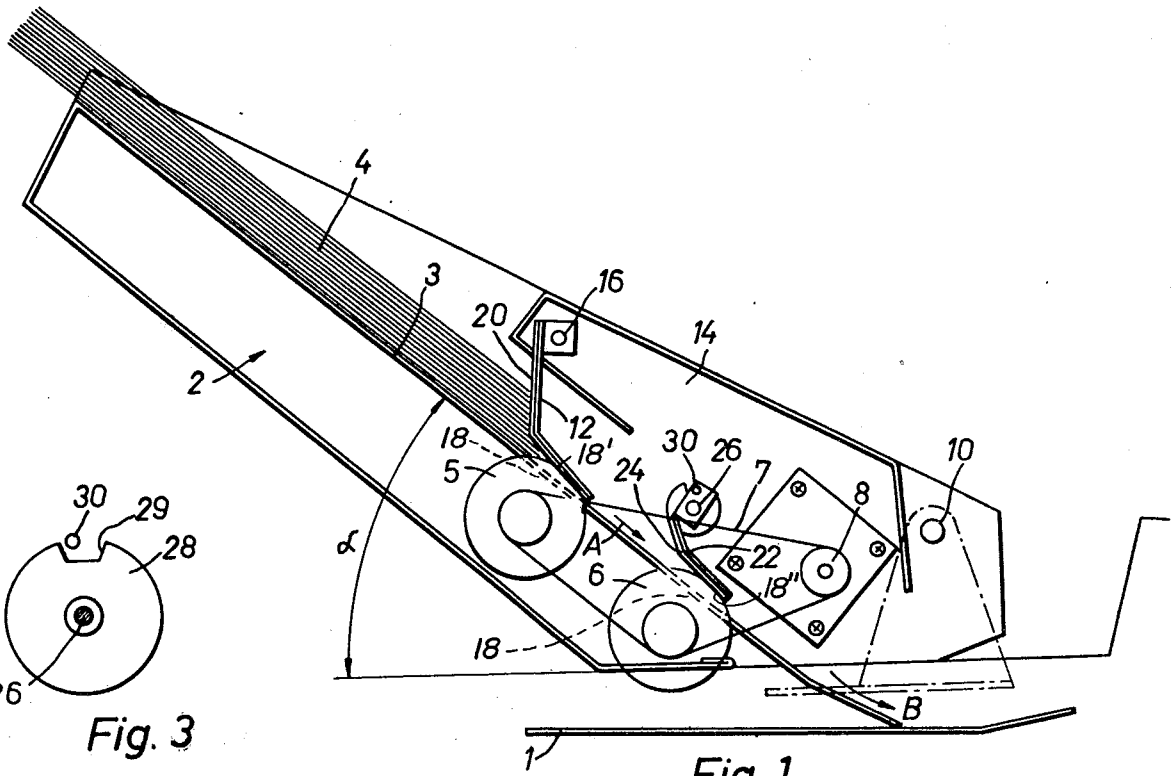
FIG. 1 shows a schematic sideview of the sheet separating device according to the invention.

DETAILED DESCRIPTION OF PREFERRED EXAMPLE EMOBIMENTS AND OF THE BEST MODE OF THE INVENTION

The device serves for feeding single sheets of paper to office machines, particularly xerographic copiers. A housing 2, located above the machine table 1 of a copying apparatus, has a bottom 3 on which rests a supply stack 4 of sheets of paper to be separated. The bottom 3 is provided with two slots 18 located one behind the other. A first separating roller 5 projects through the upper slot 18 and the second separating roller 6 projects through the lower slot 18 in the bottom 3. Each of these rollers 5 and 6 is provided with a friction facing, particularly of soft rubber. These two rollers are jointly driven by a belt 7 and an electric motor 8. The entire housing 2 is rotatable relative to the copying apparatus about an axis 10 of rotation, so that it may be swiveled upwardly into a non-operating position. The housing 2 is inclined so that the bottom 3, or at least a part of the same, assumes a sloping position at an angle of between 30° to 50°, but preferably at about 35° to the horizontal.

The separation of the single sheets in the supply stack 4 takes place by means of preliminary and secondary separation devices located relative to each other upstream and downstream as viewed in the feed advance direction A. The upstream and downstream separation devices cooperate to withdraw each time the bottommost sheet, that is, the sheet resting against bottom 3, is drawn off.

Figure 2:
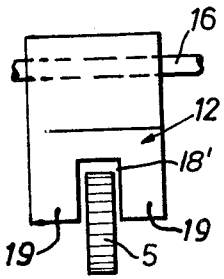
FIG. 2 is a detail view substantially in the direction of the arrow C in FIG. 1.

A separating plate 12 cooperates with a separating roller 5 to cause the preliminary separation. The separating plate 12 is rigidly secured to a rod 16 which is braced against turning in the side walls 14. As shown in FIG. 2, the separating plate 12 has a slot 18' which registers with the respective upper slot 18 in the bottom 3. Slot 18 forms two fingers 19. The separating roller 5 reaches into the slot 18'. The construction is such that the separating roller 5 juts out above the fingers 19 to a small extent. The almost vertically extending upper part of the separating plate 12 supports a portin of the supply stack 4, while the downstream part which forms a kink gently slopes with the fingers 19 toward the bottom 3. The side of the separating plate 12 facing the paper is provided with a friction facing 20, for example of soft rubber.

Figure 3:
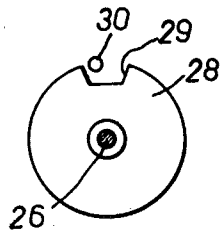
FIG. 3 shows, on an enlarged scale, a further detail of a tilt limiting member also shown in FIG. 1.

The elements for the subsequent downstream separation are constructed in an analogous manner, in that the separating roller 6 is also arranged to cooperate with a plate-like separating flap 22. This flap 22 also has, on its underside, a friction facing 24, which is made, for example, of soft rubber. The separating flap 22 rests on an axis 26 and is able to tilt to a limited extent. For this purpose, an adjustable disc 28, which butts against the side walls 14, has a notch 29, please see FIG. 3. A pin 30 for limiting the tilting of the separating flap 22 reaches into the notch 29. Since the pin 30 has a diameter smaller than that of the notch 29, the free play determines the possible angle of tilting of the separating flap 22. The separating flap 22 may be pressed downwardly by means of a weak spring not shown.

The downstream separating mechanism having the separation roller 6 and the separating flap 22, functions in a manner analogous to that of the preliminary or upstream separating means, that is, the separating roller 6 reaches through the lower slot 18 in the bottom 3. The lower slot 18 registers with a slot 18 in the separating flap 22, similar to slot 18' in the upper separating flap 12.

The mode of operation of the present device is as follows. A supply stack 4 of single sheets of paper is placed upon the standard bottom 3 by hand. The two separating rollers 5 and 6 are driven by means of a tooth belt 7 when the electric motor 8 is switched on, whereby it may be advantageous to have the separating roller 5 run slower than the separating roller 6.

When the supply stack has a given thickness, a part of its weight is supported by the vertical portion of the separating plate 12, whereas the bottommost sheets arrive in the range of the separating roller 5. When this separating roller 5 turns, the bottommost sheet, or at most more than one sheet, is grasped, moved past the separating plate 12, and is transported in the direction of arrow A. The dimensions are selected so that the paper which is transported past the separating plate 12 must assume a slight curvature since both lateral fingers 19 of the separating plate 12 and the separating roller 5 slightly overlap each other. Since, depending on the thickness of the paper used, it is possible that more than one sheet is allowed to pass through and be transported during the preliminary separation, a downstream separating mechanism is provided which avoids with certainty the simultaneous exit of more than one sheet. A sheet, or at most several sheets, having left the preliminary separating mechanism and having been transported in the direction of the arrow A, arrives in the range of the separating roller 6 and the separating flap 22. Here, the separation operation is practically the same as in the preliminary separation.

Only the bottommost sheet is transported, while an occasional upper sheet adheres or clings to the friction facing 24 of the separating flap 22 and is only transported when the lowest sheet has left the separating roller 6. The separating flap 22 is lifted somewhat in its range of tilting according to the thickness of paper and if, at most, several superposed sheets are conveyed. The separated sheets of paper move one after the other in the direction of arrow B and are moved along the downstream section of the bottom 3. After that, the sheets are conveyed on the machine table 1 by means of further transport mechanisms in the machine in a known manner.

Although the invention has been described with reference to specific example embodiments, it is to be understood that it is intended to cover all modifications and equivalents within the scope of the appended claims.

What is claimed is:

1. A device for separating sheets of paper from a stack and for feeding the sheets to an office machine, comprising bottom means (3) for supporting the sheet stack (4), said bottom having longitudinally aligned slots (18) therein, at least a portion of said bottom means being inclined to the horizontal, first separating means (5, 12) operatively arranged for cooperation with said bottom means, and second separating means (6, 22) also operatively arranged for cooperation with said bottom means downstream of said first separating means (5, 12) as viewed in the direction of sheet advance, wherein each of said first and second separating means comprises at least one first and second plate-like separating member (12, 22) provided with a friction facing (20, 24) and at least one first and second separating roller (5, 6) also provided with a friction facing, said first and second separating rollers (5, 6) reaching upwardly through the respective slot (18) in the bottom means (3), whereby a sheet is supported by said bottom means even downstream of said first and second separating rollers (5, 6), said first and second separating members (12, 22) being arranged above the respective separating roller, wherein each of the plate-like separating members (12, 22) comprises two fingers (19) forming further slots (18', 18'') in register with said slots (18) in the bottom means (3), whereby said separating roller (5, 6) is reaching between the fingers (19) of the respective separating member (12, 22) to such an extent that a sheet of paper transported through the gap between the separating member and the separating roller assumes a somewhat flat curvature, and wherein the separating member (12) of the first separating means is rigidly secured and held in position, said first separating member (12) having an angularly extending upper section, whereby a portion of the stack rests against said upper section, said first separating member further comprising a lower section forming said fingers (19), said device further comprising tilting means for the downstream, second separating member (22), whereby said downstream, second separating member (22) is tiltable through a limited angle.

2. The separating device of claim 1, further comprising means including a horizontal axis (10), for tilting the entire device within a given angular range from about 30° to 50°, preferably about 35°.

* * * * *